United States Patent [19]

Feese et al.

[11] Patent Number: 4,467,596

[45] Date of Patent: Aug. 28, 1984

[54] SZ TWISTING DEVICE FOR ELEMENTS OF ELECTRIC CABLES AND LINES TO BE TWISTED

[75] Inventors: Wolfgang Feese, Neustadt; Dieter Vogelsberg, Coburg, both of Fed. Rep. of Germany

[73] Assignee: Siemens Aktiengesellschaft, Munich, Fed. Rep. of Germany

[21] Appl. No.: 446,874

[22] Filed: Dec. 6, 1982

[30] Foreign Application Priority Data

Dec. 8, 1981 [DE] Fed. Rep. of Germany ..... 3149159

[51] Int. Cl.[3] ..... H01B 13/04

[52] U.S. Cl. ..... 57/293

[58] Field of Search ..... 57/3, 6, 9, 204, 282, 57/293, 294, 311

[56] References Cited

U.S. PATENT DOCUMENTS

| | | | |
|---|---|---|---|
| 3,025,656 | 3/1962 | Cook . | |
| 3,052,079 | 9/1962 | Henning . | |
| 3,593,509 | 7/1971 | Feese et al. | 57/293 |
| 4,339,913 | 7/1982 | Vogelsberg . | |

FOREIGN PATENT DOCUMENTS

| | | |
|---|---|---|
| 1510108 | 7/1970 | Fed. Rep. of Germany . |
| 2058325 | 5/1972 | Fed. Rep. of Germany . |
| 2232329 | 1/1974 | Fed. Rep. of Germany . |
| 2648140 | 4/1978 | Fed. Rep. of Germany . |
| 2812208 | 10/1979 | Fed. Rep. of Germany . |

*Primary Examiner*—Donald Watkins

*Attorney, Agent, or Firm*—Kenyon & Kenyon

[57] ABSTRACT

For fixing the reversal points of the twist direction in SZ twisted elements of electric cables and lines to be twisted, a device is provided which runs along in sections with the continuously moved material to be twisted and includes clamping tongs for gripping the twisted assembly and an associated device for joining the elements to be twisted together. The clamping tongs and the joining device are arranged between the stationary twisting tool and the following stationary torsion stopper. The device for joining the elements to be twisted together preferably comprises rotatable clamping tongs which may be arranged between two non-rotating clamping tongs.

10 Claims, 4 Drawing Figures

SZ TWISTING DEVICE FOR ELEMENTS OF ELECTRIC CABLES AND LINES TO BE TWISTED

This invention relates to technology for electric cables and lines in general and more particularly to continuously operating SZ twisting machines which contain an additional device for influencing the reversal points of the twist direction produced in the twisted material.

In SZ twisting of twisting elements of electric cables and wires, the reversal points of the twist direction in the twisted assembly represent critical regions which may turn out to be weak points in the further processing of the twisted assembly or in the operation of the cable or the line. This is true, for instance, in the manufacture of multi-wire conductor cables, of conductor groups such as spiral quads or of multi-conductor flexible electric lines. It is therefore desirable to make the length of the reversal points as short as possible and to ensure sufficient twisting of the elements to be twisted even in these regions. In this connection, it is known, in the case of one SZ twisting device, for the twisting device itself to be followed by a post twisting device which essentially ensures the twisting quality in the vicinity of the reversal points of the twist direction. The post twisting device is located between the revolving twisting tool which is fixed at the exit of the SZ twisting device and the stationary torsion stopper following the twisting tool, in the form of a deflection roller or a pull-off pulley (European Patent No. 0 018 312).

It is furthermore known to join SZ twisted twisting elements of electric cables and lines together with a tight material bond in the vicinity of the reversal points of the twist direction by applying an adhesive, or to shorten the length of lay in these regions (DE-OS No. 15 10 108). In one intermittently operating SZ twisting device, this is achieved by providing the revolving twisting head arranged between two non-rotating clamping jaws with two non-rotating tongs arranged on both sides which shorten the twist sections shortly before the twisting process is completed, whereby a shorter twist is obtained at the reversal point of the twist direction than in the remaining region of the twisted assembly (DE-OS No. 20 58 2325). However, the production rate of such an SZ twisting device is limited because of its intermittent operation. This is true for other known SZ twisting devices in which a sectional rotating twisting head is arranged between the two non-rotating clamping jaws (for instance, in the form of a deflection roller around which the material to be twisted is looped) and in which the twisting head and the clamping tongs run alternatingly along with the material to be twisted and are returned to a starting position by an appropriate drive mechanism (U.S. Pat. Nos. 3,025,656 and 3,052,079).

SZ twisting devices, in which a torsion stopper or a revolving twisting head is moved back and forth by means of an appropriate chain drive or a cross-thread spindle in the longitudinal direction of the material to be twisted are also known. (DE-AS Nos. 22 32 329 and 26 48 140).

Starting from an SZ twisting device it is an object of the present invention to provide, for continuously operating SZ twisting machines, a device for fixing the reversal points of the twist direction produced in the material to be twisted which does not interfere with the twisting process itself.

SUMMARY OF THE INVENTION

According to the present invention, for solving this problem, the device for influencing the reversal points of the twist direction comprises clamping tongs which sectionally grip the elements to be twisted and can be moved back and forth in the direction of the material to be twisted, and of a device associated with the clamping tongs for joining the elements to be twisted together.

With an SZ twisting device designed in this manner, it is ensured that the reversal points of twist direction are fixed at the time of their formation first temporarily by the clamping tongs and subsequently, permanently under the action of the joining device. The permanent fixation can be performed by an intimate joining of the material such as cementing (in the case of conductor groups), soldering or welding (in the case of conductor cables). Especially in the case of conductor cables, a form locking connection can also be made by shortening the twist length of the conductor wires in the vicinity of the reversal points, accompanied by a plastic deformation of the conductor wires. For this purpose, a joining device which consists of rotatable clamping tongs, may be arranged between two non-rotating clamping tongs.

With the new SZ twisting device, it is furthermore advantageous for the clamping tongs to assume, during the time interval in which they grip the material to be twisted frictionally, the function of the torsion stopper which follows the revolving twisting tool. Thus, the device for fixing the reversal point fits naturally into the continuously proceeding twisting process.

The device for fixing the reversal points runs along with the twisted assembly for a distance which is smaller than the distance between two successive reversal points. This distance is chosen, for instance 20% smaller than the distance between two reversal points. Then, the fixing device, after passing through the available distance, has enough time to execute its return movement to the immediate vicinity of the revolving twisting tool. This return movement can take place, for instance, by means of a return spring if the fixing device is taken along by the material to be twisted. However, a reversing drive which takes the fixing device along with the material to be twisted and subsequently returns it against the direction of motion of the material to be twisted may be provided.

The distance available to the fixing device for a run may also be chosen longer than the distance of two reversal points of the twist direction if two or more fixing devices consisting of a clamping device and a joining device are employed. The individual fixing devices coming into use successively must then be returned parallel to the axis of the material to be twisted.

DETAILED DESCRIPTION

Figure 1:
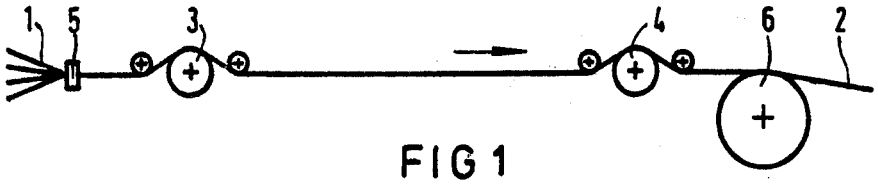
FIGS. 1 and 2 are schematic illustrations of two different continuously operating SZ twisting devices.

FIG. 1 shows an SZ twisting device, in which, for twisting the twist elements 1 to form the twisted group 2, a device known as a double-twister SZ device is provided which consists of two revolving twisting heads 3 and 4, a twisting closer 5 preceding the first twisting head, and a torsion stopper 6 in the form of a pull-off pulley following the second twisting head. The rotary motions of the twisting heads 3 and 4 are changed synchronously at intervals.

Figure 2:
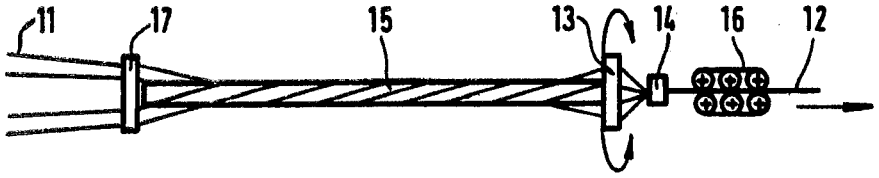

The SZ twisting device according to FIG. 2 is a tubular accumulator SZ twisting machine by means of which elements to be twisted 11 are twisted to form a twisted group 12. For this purpose, the machine consists of a twisting disc 13 which revolves with alternating direction of rotation, followed by a twisting closer 14 and preceded by a tubular accumulator 15 with a stationary perforated disc 17. The torsion stopper 16 following the twisting tool elements 13 and 14 comprises a caterpillar pulling-off device.

Figure 3:
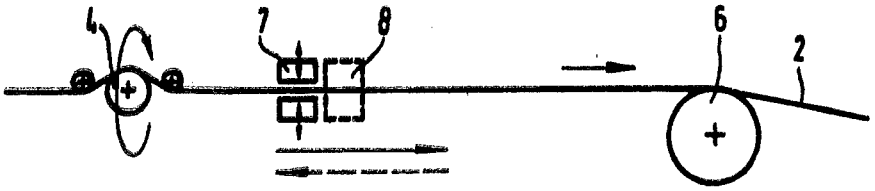
FIGS. 3 and 4 are schematic illustrations of the additional equipment with a device for fixing the reversal points.

According to FIG. 3, a device for fixing the reversal points of the twist direction which consists of clamping tongs 7 which are stationary in the circumferential direction of the material to be twisted and a device 8 for joining the twisting elements to each other are arranged between the rotating twisting head 4 and the torsion stopper 6. The clamping tongs 7 and the joining device 8 are arranged directly side by side and can be moved together back and forth in the travel direction of the material to be twisted. The joining device 8 is a cementing, soldering or welding device.

Figure 4:
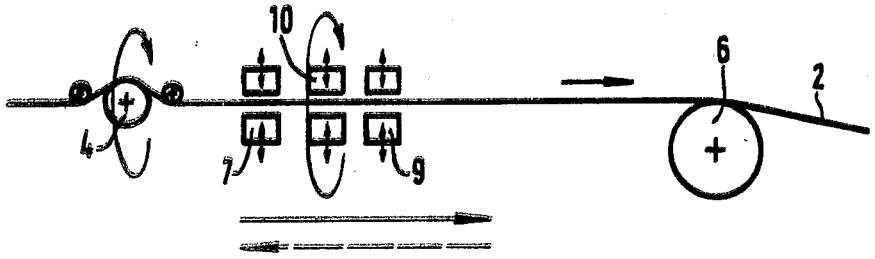

According to FIG. 4, second stationary clamping tongs 9 are associated with the clamping tongs 7, a rotatable pair of clamping tongs 10 being disposed between these two clamping tongs. This device, consisting of three clamping tongs, can likewise be moved back and forth in the travel direction of the material to be twisted. The clamping tongs 7, 9 and 10 come into engagement with the material to be twisted when a twist reversal point is being formed and first run along with the material to be twisted in the pulling-off direction and are later returned quickly. The middle clamping tongs 10, clamp on the material in the region of the reversal points. The clamping tongs 7 and 9 retain a fixed angular position. The middle clamping tongs 10, on the other hand, rotate constantly, or in a pulsed fashion, in one direction, as long as the frictional connection to the material to be twisted is maintained. In the case of reversal points from S twist to Z twist, the central part rotates, for instance, clockwise, and in the transition form Z twist to S twist, counterclockwise.

Since the clamping tongs 7, 9 and 10 run along with the material to be twisted, only relatively low speeds of revolution are required for the rotatable clamping tongs 10 for the additional twisting process in the vicinity of the reversal points. If, for instance, an SZ twisting device according to FIG. 1 is used, the pulling-off speed is, for instance, $v=120$ m/min and the changing speeds of rotation of the twisting heads are 1000 RPM and 2000 RPM, respectively, a length of lay $s=120$ mm is obtained if a spiral quad is produced. If a fixing device according to FIG. 4 is now allowed to run along for a distance of 2 m, where the distance between the clamping tongs 7 and 9 is 120 mm, ir order to shorten the length of lay in the vicinity of the reversal point from +120 mm to +20 mm, then the rotatable clamping tongs 10 need only rotate about the twisting axis at a speed of rotation of +300 and −300 RPM, respectively.

If the distance between the rotating twisting tool and the following torsion stopper is substantially smaller than the distance of two successive reversal points, the twisting tool and the torsion stopper can take over the function of the two non-rotating clamping tongs which are arranged on both sides of the rotatable clamping tongs. In this case, a single rotating pair of clamping tongs which runs back and forth in the longitudinal direction of the material to be twisted is used. In that case the clamping tongs, and the corresponding to rotary drive which forms part of the joining device, form a structural unit. The region in which the length of lay of the material to be twisted is shortened, corresponds then, almost, to twice the distance of the rotating twisting tool from the following torsion stopper.

What is claimed is:

1. In an SZ twisting device for elements of electric cables and lines to be twisted comprising at least one rotating twisting tool which is fixed at the exit of the twisting device, a stationary torsion stopper following the rotating twisting tool, and a device for influencing the reversal points of the twist direction in the material to be twisted arranged between the twisting tool and the torsion stopper, the improvement comprising:

(a) the device for influencing the reversal points comprising clamping tongs which grip the elements to be twisted sectionally, said clamping tongs supported for movement back and forth in the direction of travel of the material to be twisted; and (b) means associated with said clamping tongs for joining the elements to be twisted to each other.

2. The improvement according to claim 1, wherein said device for influencing the reversal points of the twist direction is free running in the direction of the material to be twisted and further including a return spring.

3. The improvement according to claim 1 wherein the device for influencing the reversal points of the twist direction is equipped with a reversing drive.

4. The improvement according to one of claims 1 to 3 wherein said device for joining the elements to be twisted together comprises a cementing, soldering or welding device.

5. The improvement according to one of the claims 1 to 3, wherein said device for joining the elements to be twisted together comprises a rotary drive for the clamping tongs.

6. The improvement according to claim 5 comprising rotatable clamping tongs arranged between two non-rotatable clamping tongs which can be moved back and forth with the rotatable clamping tongs.

7. The improvement according to claim 6 wherein the distance between the fixed twisting tool and the torsion stopper is smaller than the distance of the reversal points in the material to be twisted.

8. The improvement according to one of claims 1–3 wherein the distance between the fixed twisting tool and the torsion stopper is smaller than the distance of the reversal points in the material to be twisted.

9. The improvement according to claim 6 wherein the distance between the fixed twisting tool and the torsion stopper is larger than the distance of the reversal points in the material to be twisted, and further including at least two clamping tongs with associated joining devices disposed between the twisting tool and the torsion stopper, the distance of the clamping tongs from each other corresponding to the distance of the reversal points of the twist direction in the material to be twisted.

10. The improvement according to one of claims 1–3 wherein the distance between the fixed twisting tool and the torsion stopper is larger than the distance of the reversal points in the material to be twisted and further including at least two clamping tongs with associated joining devices disposed between the twisting tool and the torsion stopper, the distance of the clamping tongs from each other corresponding to the distance of the reversal points of the twist direction in the material to be twisted.

* * * * *